United States Patent [19]

Liles et al.

[11] Patent Number: 4,980,992

[45] Date of Patent: Jan. 1, 1991

[54] REVOLVING DOOR ASSEMBLY WITH FOLDABLE DOOR WINGS

[75] Inventors: William S. Liles; Lew V. Hewitt; David P. Hewitt, all of Corpus Christi, Tex.

[73] Assignee: Overhead Door Corporation, Dallas, Tex.

[21] Appl. No.: 421,544

[22] Filed: Oct. 13, 1989

[51] Int. Cl.[5] ..... E05D 15/02

[52] U.S. Cl. ..... 49/44

[58] Field of Search ..... 49/44, 42, 43

[56] References Cited

U.S. PATENT DOCUMENTS

| | | | |
|---|---|---|---|
| 14,255 | 2/1917 | Van Kannel | 49/44 |
| 1,007,025 | 10/1911 | Ely . | |
| 1,030,266 | 6/1912 | Ramondt | 49/44 |
| 1,536,196 | 5/1925 | Dyer . | |
| 1,983,353 | 12/1934 | Ely et al. | 49/44 |
| 2,523,980 | 9/1950 | Whiteford . | |
| 3,782,098 | 10/1973 | Scheckells | 49/44 |
| 3,792,035 | 1/1974 | Lowe | 49/44 |
| 3,793,773 | 2/1974 | Sheckells | 49/44 |
| 3,897,651 | 8/1975 | Scheckells | 49/44 X |
| 4,565,030 | 1/1986 | La Sance | 49/44 |

*Primary Examiner*—Philip C. Kannan

*Attorney, Agent, or Firm*—Kenneth R. Glaser

[57] ABSTRACT

A revolving door assembly in which the individual door wings are releasably secured to a central support member, such that the door wings are retained in respective operative positions in which the wings extend substantially radially from the central hub in diametrically opposed pairs. The door wings are releasable from their operative positions in response to the exertion of a predetermined force thereon to allow one or more of the door wings to be rotated about their respective pivot axes to a folded position. The support member has a plurality of arm members projecting substantially radially therefrom. Each door wing is attached to a corresponding arm member by means of a ball and catch mechanism at a distal position relative to the support member. The ball is disengaged from the catch to allow the door wing to swing free of the arm member when a predetermined force is exerted thereon. An elongated bar is positioned between an inner portion of each door wing and the support member for maintaining each door wing substantially in vertical alignment when the door wing is rotated about its pivot axis. Each door wing is pivotally mounted for rotation about first and second pivot axes, which are spaced apart sufficiently to allow the door wings to be substantially completely "bookfolded".

27 Claims, 5 Drawing Sheets

REVOLVING DOOR ASSEMBLY WITH FOLDABLE DOOR WINGS

FIELD OF THE INVENTION

This invention relates to revolving doors and particular to a revolving door assembly in which the door wings are collapsible to a book-fold position.

1. Background of the Invention

Revolving doors are typically used in office buildings and the like to isolate the interior of a building from the outside elements, which enhances the efficiency of the heating and cooling system of the building and the comfort level within the building. It is desirable to be able to collapse the individual door wings of a revolving door assembly in the event that the door becomes stuck or otherwise inoperative and also in the event that rapid access to or egress from the building is required, such as in an emergency.

2. Description of the Prior Art

According to prior practice, revolving door assemblies typically include means for latching the individual door wings in respective fixed positions such that the door wings extend substantially radially outward from a central shaft, which rotates to revolve the door wings. The latch means will typically be released when a corresponding door wing is subjected to abnormal pressure. When the latch means is released, the door wing can be pivoted about a vertical axis, which is typically located close to the central shaft of the mechanism. By pivoting the door wings about their respective pivot axes, the door wings can be at least partially folded to permit passage through the revolving door assembly on either side of the folded door wings.

One problem associated with prior art revolving door assemblies is that the top and bottom parts of each door wing may be rotated by different amounts when the corresponding latch mechanism is released. This results in the bottom of the door being canted with respect to the top thereof and the resulting torque on the door wing can cause damage thereto.

Another problem associated with some prior art revolving door assemblies is that the latch mechanism is located adjacent to the pivot axis and the central shaft. Therefore, when abnormal pressure is exerted on an outer part of the door wing, radially removed from the latch mechanism, the latch mechanism will be subjected to a substantial torque, thereby necessitating the use of a large spring member to retain the latch mechanism in position for normal operation and accelerating the failure of the "wear" surfaces associated with the latch mechanism.

Yet another problem associated with prior art revolving doors is that the door wings cannot be fully folded to a bookfold position because, during rotation, a door wing will bump into an adjacent door wing, which thereby limits its rotation. This is caused by the pivot axis being positioned near the central shaft, such that the outer portion of each door wing will swing a greater distance during rotation than the inner portion thereof adjacent to the pivot axis.

OBJECTS OF THE INVENTION

It is, therefore, the principal object of the invention to provide an improved revolving door assembly.

Another object of the invention is to provide a revolving door assembly in which the door wings can be broken out and folded substantially parallel and adjacent to one another, similar to the leaves of a book.

Yet another object of the invention is to provide means for maintaining the door wings of a revolving door assembly substantially in vertical alignment when the wings are rotated and folded.

Still another object of the invention is to provide an improved latch mechanism for a revolving door assembly.

SUMMARY OF THE INVENTION

These and other objects were accomplished in accordance with the present invention wherein a revolving door assembly is comprised of rotary central support means, a plurality of door wings mounted on the support means for revolving motion about a central axis, means for pivotally mounting the door wings relative to the support means so that the door wings are rotatable about respective pivot axes parallel to the central axis, and means for releasably securing the door wings to the support means such that the door wings are retained in respective operative positions in which the wings extend substantially radially from the central shaft. The securing means is released in response to a predetermined force being exerted on a door wing to allow the door wing to be rotated about its pivot axis to a folded position.

In accordance with one feature of the invention, a plurality of arm members project substantially radially outward from the central support means. The door wings are releasably secured to the respective arm members at respective distal positions relative to the central axis. The door wings are pivotally mounted on the respective arm members at respective locations other than the respective distal portions, such that When the securing means is released by the exertion of a predetermined force on the door wing, the door wing can be pivoted relative to its corresponding arm member to the folded position.

In one embodiment, the securing means includes latch means for securing a distal portion of each door wing to a distal portion of the corresponding arm member. In another embodiment, the latch means includes first and second latch members, the first latch member being disposed on an outer portion of the door wing, and the second latch member being disposed on an outer portion of the corresponding arm member. In the preferred embodiment the first latch member includes a ball catch, which is spring-biased to an extended position for mating with an opening in the second latch member to secure the first and second latch members together. When the predetermined force is exerted on the door wing, the first latch member will move laterally relative to the second latch member to overcome the spring bias and move the ball catch out of engagement with the opening in the second latch member. When the first and second latch members are disengaged, the door wing can be pivoted with respect to the corresponding arm member, which remains in a fixed position relative to the central support means.

In accordance with another feature of the invention, each door wing is pivotally mounted relative to the central support means for rotation about first and second pivot axes both of which are parallel to the central axis. The second pivot axis is positioned outwardly of the first pivot axis, such that the first pivot axis is between the second pivot axis and the central axis. The distance between the first and second pivot axes is at least as great as the distance between the central axis and the first pivot axis plus the thickness of the door wing, as measured along an axis substantially perpendicular to a major surface of the door wing. In this configuration, the door wing can be pivoted about its first pivot axis until the door wing comes into contact with an adjacent door wing, whereupon the door wing can be pivoted about its second pivot axis so that the individual door wings can be substantially completely "book folded".

In one embodiment, the means for pivotally mounting the door wings relative to the support means includes hinge means positioned at the top and bottom of each door wing. In the preferred embodiment, each hinge means includes a first hinge member which is mounted for rotation about the first pivot axis at the top and bottom of the door wing and a second hinge member which is mounted for rotation about the second pivot axis at the top and bottom of the door wing. The first hinge member is constrained from rotation about the second pivot axis. In the preferred embodiment, each hinge means is comprised of a plurality of first hinge members in vertical stacked arrangement and a plurality of second hinge members in vertical stacked arrangement to provide a tight fitting hinge mechanism. Spacer members are interleaved between the stacked first hinge members and the stacked second hinge members as needed.

In accordance with yet another feature of the invention, means is provided for, stiffening each door wing, so that top and bottom portions of each door wing are maintained substantially in vertical alignment when the door wing is rotated about its pivot axes. In one embodiment the alignment means includes an elongated bar for being positioned substantially in abutment with an inner portion of each door wing, such that the bar is disposed between the door wing and the central axis. The elongated bar is rotatable along with the door wing about the pivot axis.

In the preferred embodiment, hinge means is disposed at the top and bottom of each door wing for pivotally mounting the door wing relative to the central support means along first and second pivot axes. The hinge means includes a first hinge member which is mounted at one end thereof to the elongated bar, such that the elongated bar constrains the first hinge members at the top and bottom of the door wing to rotate substantially together. A second hinge member is pivotally attached to an opposite end of the corresponding first hinge member to define the second pivot axis. The first pivot axis extends along a major axis of the elongated bar, such that the door wing and bar are rotatable about the first pivot axis.

BRIEF DESCRIPTION OF THE DRAWINGS

Further objects and advantages of the invention will be apparent from the Detailed Description and claims when read in conjunction with the accompanying drawings wherein:

DETAILED DESCRIPTION OF PREFERRED EMBODIMENT

In the description which follows, like parts are marked throughout the Specification and Drawings, respectively. The Drawings are not necessarily to scale and in some instances proportions have been exaggerated in order to more clearly depict certain features of the invention.

Figure 1:
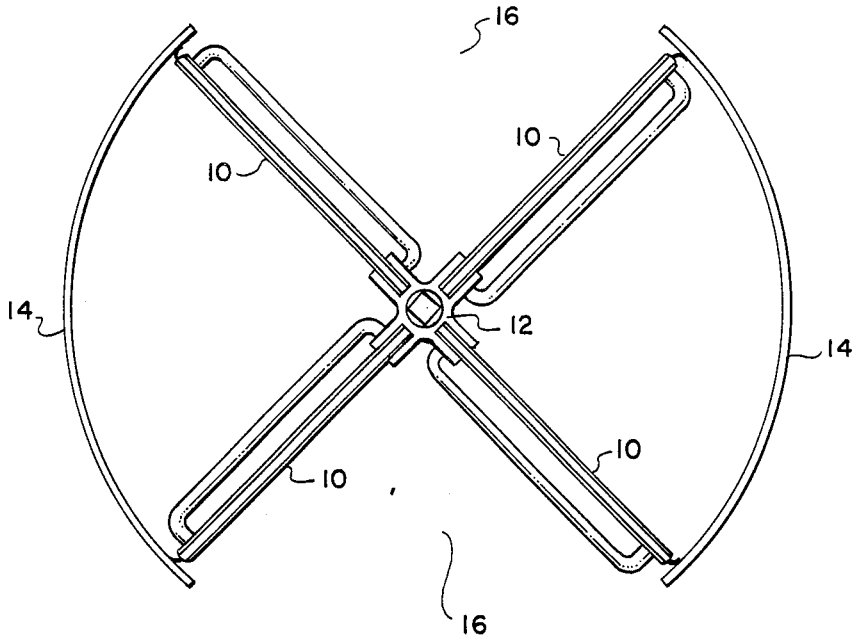
FIG. 1 is a top plan view of a revolving door assembly according to the present invention.

Referring to FIG. 1, a revolving door assembly includes four relatively flat door wings 10 extending radially outward from a rotatable central support member 12. The revolving door assembly is disposed within a semi-enclosed housing, which is comprised of a pair of arcurate drums 14 and a pair of throat openings 16 disposed between drums 14. To operate the revolving door assembly, one enters the housing through one of throat openings 16 and exerts pressure on the face of one of the two facing door wings 10, thereby causing the entire assembly to rotate. The user walks along with the rotating assembly until he is able to exit the housing through the opposite throat opening 16. The direction of rotation can be either clockwise or counterclockwise, as viewed from the perspective of FIG. 1, depending upon the particular door wing 10 on which the user exerts pressure.

Figure 2:
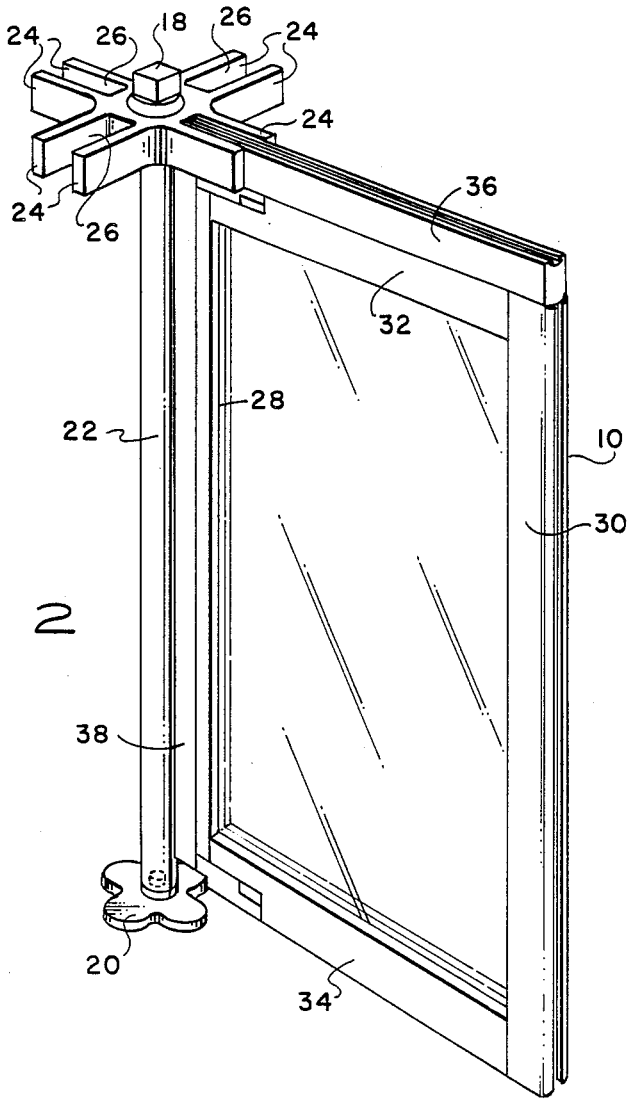
FIG. 2 is a perspective view of a portion of the revolving door ass of FIG. 1.

Referring to FIG. 2, the support member includes top and bottom spider members 18 and 20, which are connected by means of a central shaft 22. Top spider member 18 has eight projections 24 arranged in four cooperating pairs, such that the individual projections 24 of each cooperating pair define a recessed region 26 therebetween.

Each door wing 10 is preferably formed of aluminum or other lightweight metal and includes an inner vertical rail 28, and outer nosing rail 30 substantially parallel to vertical rail 28 and top and bottom horizontal rails 32 and 34 extending between vertical rail 28 and nosing rail 30 to define a substantially rectangular frame for the corresponding door wing 10. In accordance with the present invention, an arm member 36 is attached to a top portion of each door wing 10 for connecting the corresponding door wing 10 to top spider member 18. An inner portion of arm member 36 is received within a corresponding recessed region 26 in top spider member 18 and is connected to the corresponding projections 24 on opposite sides of the corresponding recessed region 26 by bolts, screws or the like (not shown) to maintain the corresponding door wing 10 in proper alignment, both radially and vertically. Each door wing 10 can be disengaged from its arm member 36 in order to rotate door wings 10 to a book-fold position, such that door wings 10 are in substantially parallel juxtaposition relative to one another. The mechanism by which door wings 10 can be "book folded" will be described in greater detail hereinafter.

Figure 3:
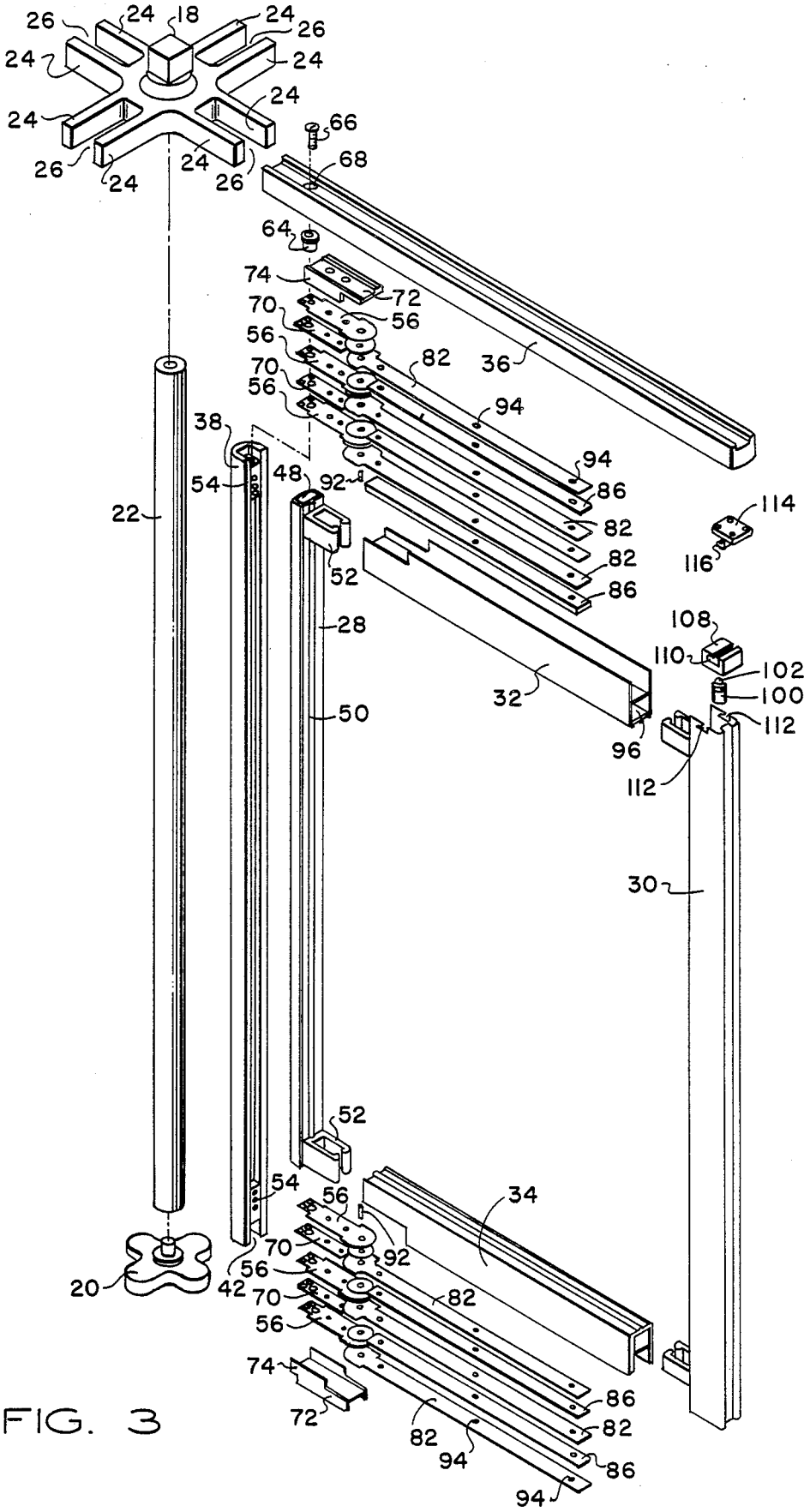
FIG. 3 is a perspective view of a portion of the revolving door assembly depicted in FIG. 2, in which certain components are broken out for illustration purposes.
Figure 4A:
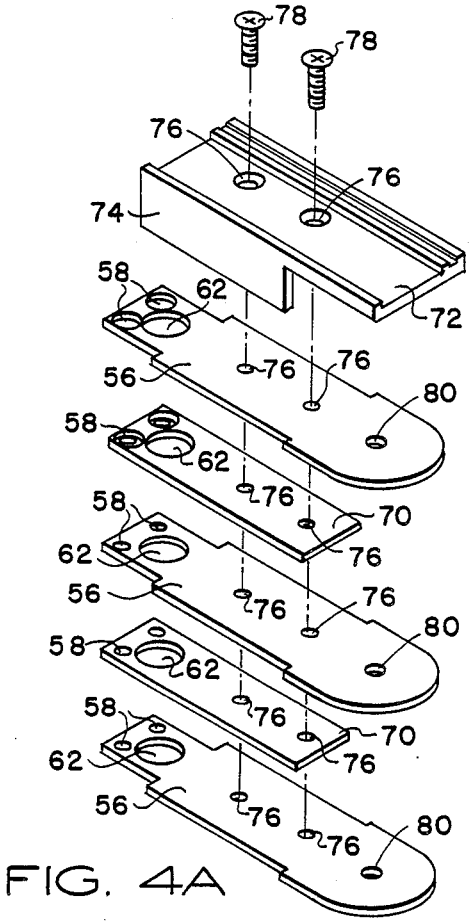
FIGS. 4A–4D are various views of the components used to pivotally mount the individual door wings of a revolving door assembly, according to the present invention.
Figure 4B:
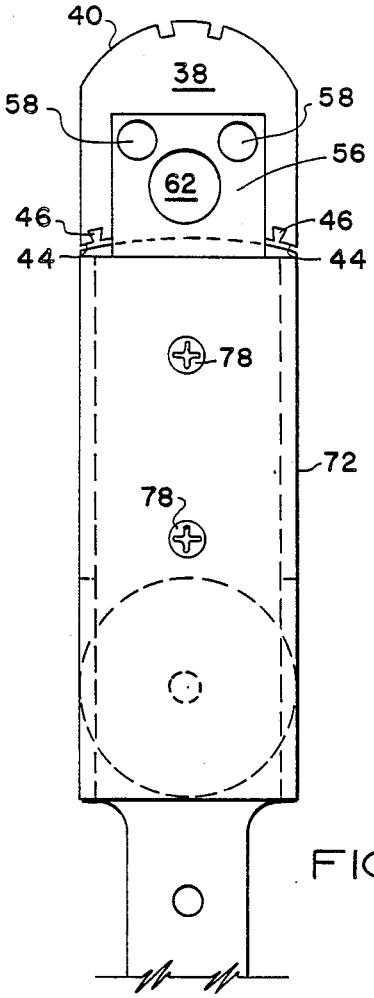
Figure 4C:
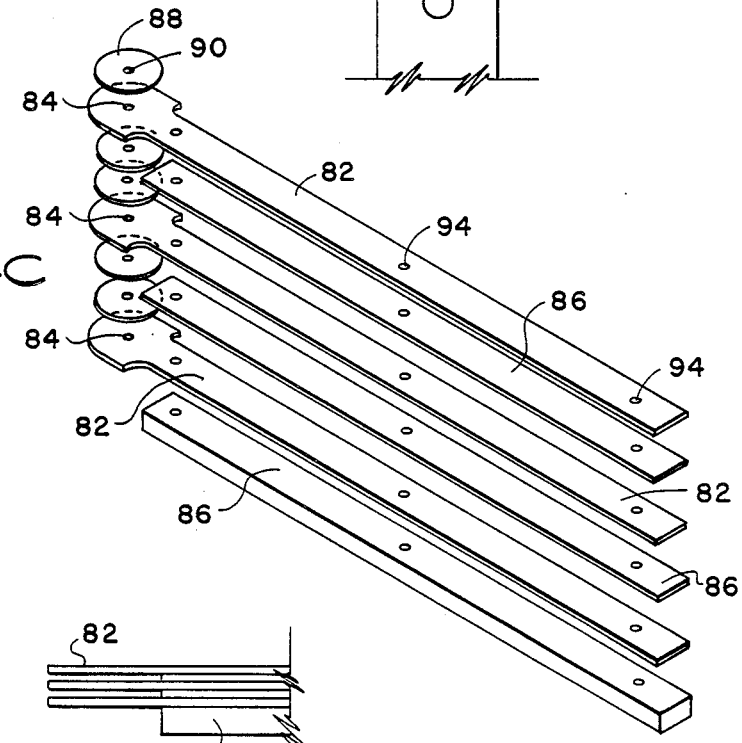
Figure 4D:
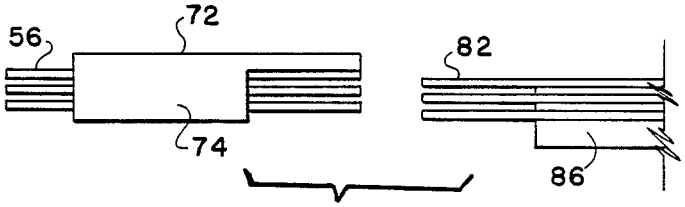

Referring also to FIG. 3, an elongated bar 38 is interposed between vertical rail 28 and central shaft 22 for maintaining top and bottom portions of a corresponding wing 10 substantially in vertical alignment, as will be described in greater detail hereinafter. As best seen in FIG. 4B, bar 38 is curved along a back surface 40 thereof and has a front facing recess 42 (see FIG. 3) extending substantially the entire length thereof. Front edges 44 of bar 38 are also curved and include trapezoidal-shaped grooves 46. Front recess 42 defines a substantially U-shaped channel along substantially the entire length of bar 38.

Figure 6A:
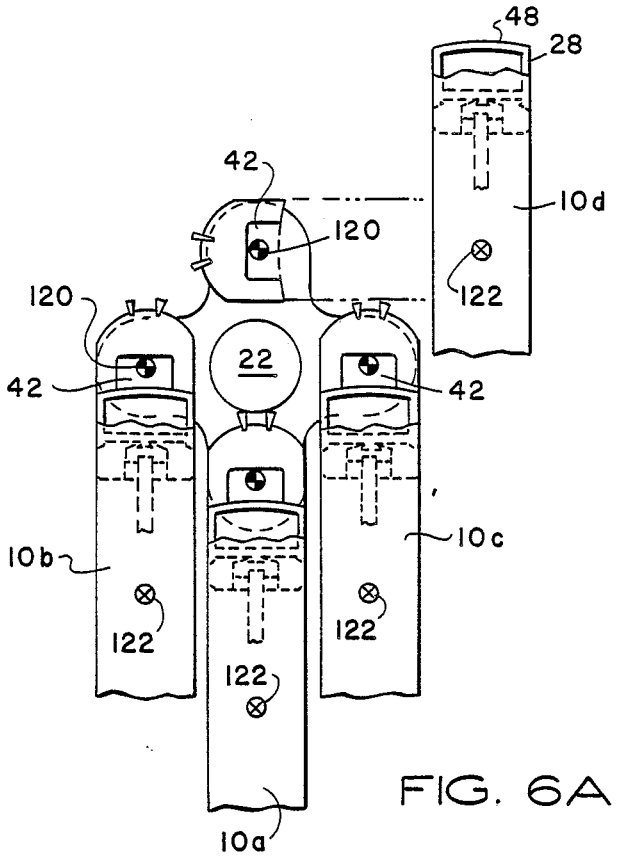
FIGURES 6A and 6B are respective top plan views depicting the breakout of four revolving door wings from respective first operative positions to a book-fold position according to the present invention.

Vertical rail 28 has a curved back surface 48 (see also FIGS. 6A and 7A) for being positioned in an abutting relationship with front surfaces 44 of bar 38, such that a portion of back surface 48 will extend slightly into recess 42 of bar 38, as best seen in FIG. 6A. Vertical rail 28 has a substantially rectangular shape and a large central opening extending substantially the entire length thereof. A projection member 50 protrudes outwardly from a front surface of vertical rail 28 for mounting top and bottom corner brackets 52.

A pair of steel blocks 54 are attached by bolts, screws or the like to an inner back wall of bar 38, within recess 42. The top steel block 54 is positioned near the top of bar 38, such that the upper surface of top steel block 54 is a predetermined distance below the top edge of bar 38. Similarly, the bottom steel block 54 is positioned near the bottom of elongated bar 38, such that the lower surface of bottom steel block 54 is a predetermined distance above the bottom edge of bar 38.

Referring also to FIGS. 4A–4D, a plurality of pivot arms 56 are provided for being attached to steel blocks 54 at the top and bottom of bar 38 for pivotally mounting the corresponding door wing 10 so that each door wing 10 can be "broken out" and folded to the book-fold position, as described above. Each pivot arm 56 has a pair of holes 58 at one end thereof for receiving screws (not shown) or other attachment members to secure pivot arms 56 to the corresponding steel blocks 54. A first plurality of pivot arms 56 are attached to an upper surface of upper steel block 54 and a second plurality of pivot arms 56 are attached to a lower surface of lower steel block 54. Elongated bar 38 therefore prevents the top pivot arms 56 from turning independently of the bottom pivot arms 56, thereby maintaining the top and bottom portions of the corresponding door wing 12 substantially in vertical alignment. The individual pivot arms 56 of each set are stacked vertically with their respective pairs of holes 58 substantially in registration for receiving the attachment screws or the like. Each pivot arm 56 further includes an aperture 62 for receiving a substantially cylindrical lower portion of a bronze bushing 64 (see FIG. 3). The lower cylindrical portion of bushing 64 is press-fit into aligned apertures 62, such that the lower cylindrical portion thereof extends all the way through aligned apertures 62 and rests on top of the upper surface of top steel block 54. A threaded pivot bolt 66 engages complementary threads in opening 68 of arm member 36, such that a lower portion of pivot bolt 66 extends all the way through opening 68 and into bushing 64, but not all the way through bushing 64. In this configuration, bushing 64 is able to pivot around fixed pivot bolt 66, when the corresponding door wing 10 is disengaged from arm member 36 to provide a primary pivot connection. Because bushing 64 is press-fit into aligned apertures 62, pivot arms 56 and elongated bar 38 will also pivot along with bushing 64 around the longitudinal axis of pivot bolt 66.

A relatively flat spacer member 70 is sandwiched between each pair of pivot arms 56 in a vertical stacked arrangement. Each spacer member 70 has a pair of holes 58 and an aperture 62 for being aligned with the corresponding holes 58 and apertures 62 in pivot arms 56. Holes 58 of the outermost pivot arm 56 and the outermost spacer member 70 (the top pivot arm 56 and top spacer member 70 in the case of the upper stack and the bottom pivot arm 56 and bottom spacer member 70 in the case of the lower stack) are countersunk for receiving the heads of the attachment screws. A relatively flat dress piece 72 having side projections 74 and a pair of openings 76 at least partially envelopes the stacked pivot arms 56 and spacer members 70 and is attached thereto by means of attachment screws 78 extending through the aligned threaded openings 76 in dress piece 72 and in the corresponding pairs of threaded openings 76 in pivot arms 56 and spacer members 70, as best seen in FIG. 4A.

A first end portion of each pivot arm 56 at which the corresponding pivot arm 56 is mounted on corresponding steel block 54 has a substantially rectangular shape and is narrower than the remaining portion of the corresponding pivot arm 56. A second end portion of each pivot arm 56, opposite from the end portion, has a tongue shape with an opening 80 extending therethrough. A plurality of elongated plates 82 have tongue-shaped end portions with respective openings 84 therein for being aligned with corresponding openings 80 in pivot arms 56, as best seen in FIG. 3. Plates 82 are shown in greater detail in FIG. 4C. A plurality of elongated shims 86 are disposed between each pair of plates 82 when plates 82 are stacked vertically and serve substantially the same spacing function as spacer members 70 previously described. A plurality of washers 88 with openings 90 extending therethrough are provided for being sandwiched between the aligned tongue-shaped portions of pivot arm 56 and plates 82. Washers 88 are preferably made of brass or plastic material. As best seen in FIG. 3, the tongue-shaped portion of each plate 82 is positioned beneath the tongue-shaped portion of a corresponding one of pivot arms 56, such that opening 84 in the tongue-shaped portion of plate 82 is aligned with opening 58 in the tongue-shaped portion of pivot arm 56.

A first set of plates 82 is connected to the first set of pivot arms 56 at the top of door wing 10 and a second set of plates 82 is connected to the second set of pivot arms 56 at the bottom of door wing 10 by means of respective first and second pivot pins 92, which extend through aligned openings 80, 84 and 90 to provide a second pivot connection, such that plates 82 can pivot relative to pivot arms 56, thereby effecting a hinge connection therebetween. Plates 82 and shims 86 each have three openings 94 for receiving attachment screws or the like (not shown) to connect plates 82 and shims 86 to the corresponding horizontal rail 32 or 34, thereby coupling elongated bar 38 to the corresponding door wing 10. Therefore, when arm member 36 is disengaged from door wing 10, the entire door wing 10 and bar 38 can be pivoted around a primary pivot axis extending through pivot bolt 66. Bar 38 will constrain pivot arms 56 at the top and bottom of the corresponding door wing 10 to move together when the corresponding door wing 10 is rotated about its primary pivot axis, thereby maintaining the top and bottom portions of the door wings substantially in vertical alignment. If the pivoting motion is retarded, such as if pivot arms 56 strike an adjacent door wing 10, door wing 10 can be pivoted around a secondary pivot axis extending through the pivot pins 92 to continue the rotation. One skilled in the art will appreciate that the vertical stacked arrangement of pivot arms 56 and spacer members 70 and the vertical stacked arrangement of plates 82 and shims 86 provide a relatively tight fitting hinge connection.

The respective top and bottom stacks of pivot arms 56 and plates 82 are received within corresponding recessed regions in top and bottom horizontal rails 32 and 34. Top and bottom horizontal rails have respective channels 96 extending substantially the entire length thereof for mating with corresponding U-shaped corner brackets 52 extending outwardly from vertical rail 28 and nosing rail 30, as best seen in FIGURE 3. Corner brackets 52 are affixed to corresponding projections 50 on the inwardly facing surfaces of rails 28 and 30. The projecting members of corner brackets 52 are tapered inwardly for being inserted into the corresponding channel 96 at each end of the corresponding horizontal rail 32 and 34 to provide a tight press-fit engagement.

Figure 5A:
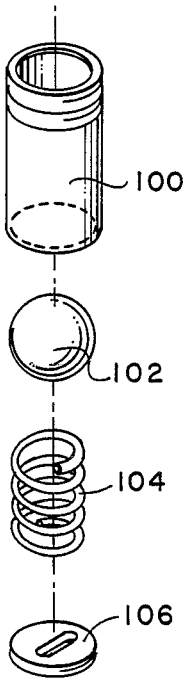
FIG. 5A–5C are various views of a ball catch mechanism used to releasably secure the individual door wings in their respective operative positions.
Figure 5B:
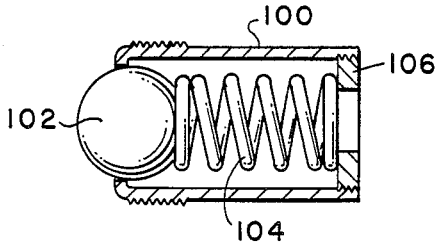

Referring to FIGS. 3 and 5A–5C, arm member 36 is attached to door wing 10 by means of a ball and catch mechanism. As best seen in FIG. 5A, the ball portion of the mechanism includes a cylindrical barrel 100 with threads on a portion of an outer surface thereof. Barrel 100 is open at both ends, but is crimped down at the threaded end so that when a chrome-plated steel ball 102 is inserted into barrel 100 through the unthreaded open end, ball 102 will be able to protrude slightly from the crimped end, but cannot escape from barrel 100 through the crimped end. A compression spring 104 is positioned below ball 102 within barrel 100 for biasing ball 102 toward the crimped end so that ball 102 will protrude slightly therefrom. A threaded retainer nut 106 engages complementary threads inside of barrel 100 to hold spring 104 in position within barrel 100.

A retaining block 108 is positioned within nosing rail 30, adjacent to the top portion thereof, such that an elongated groove 110 in retaining block 108 is substantially in alignment with notches 112 in the top edges of nosing rail 30. Retaining block 108 has a threaded opening therein for mating with complementary threads on the outer surface of barrel 100, such that when barrel 100 is threadedly connected to retaining block 108, a portion of ball 102 will protrude into groove 110 and retaining block 108.

A hook member 114 is affixed to an undersurface of arm member 36, adjacent to a distal end thereof. Hook member 114 includes an L-shaped member 116 on an undersurface thereof for mating with groove 110, such that L-shaped member 116 is able to slide within groove 110.

Figure 5C:
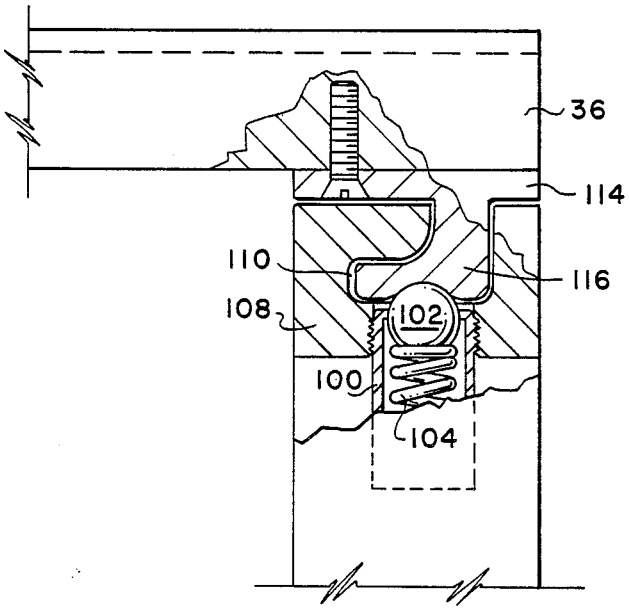

When arm member 36 is positioned substantially in registration with nosing rail 30, as shown in FIG. 2, L-shaped member 116 is received within groove 110 and ball 102 is received within a recessed region in a bottom surface of L-shaped member 116, which is in facing relationship with ball 102, as shown in FIG. 5C. The portion of L-shaped member 116 surrounding the recessed region engages ball 102 to substantially prevent sliding movement of L-shaped member 116 within groove 110, thereby securing the entire door wing 110 to arm member 36.

When it is desired to "break out" door wing 10 from arm member 36, sufficient force is exerted on door wing 10 to overcome the spring bias of spring 104 and disengage ball 102 from the recessed region of L-shaped member 116. When ball 102 is disengaged from the recessed region, L-shaped member 116 can slide within groove 110 because the bottom facing surface of L-shaped member 116 will compress ball 102 downwardly into barrel 100 against the spring bias. The continued exertion of pressure on doorway 110 will completely disengage hook member 114 from retaining block 108, such that door wing 10 can pivot freely around either or both of the primary and secondary pivot axes.

By positioning the ball and catch mechanism near a distal end of each door wing 10, instead of near the primary pivot axis, a smaller spring member can be used to secure the door wing in its normal operating position in engagement with arm member 36. Typically, when pressure is exerted on the door wing, it is exerted on a distal portion thereof, radially outward from the primary pivot axis, so that by positioning the ball and catch mechanism radially outward from the primary pivot axis, the torque exerted on the ball and catch mechanism will be reduced for a given force exerted on door wing 10, which reduces wear and tear on the ball and catch mechanism.

Figure 6B:
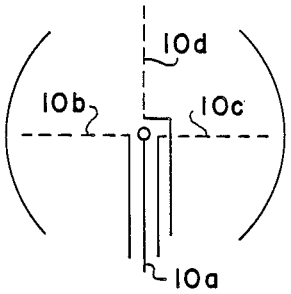

Referring to FIGS. 6A and 6B, the revolving door assembly comprised of four door wings **10*a*–10*d* is shown with the four door wings 10*a*–10*d* broken out from a "plus" position, as shown in FIGURE 6B. The dashed lines in FIG. 6B represent the respective positions of door wings 10*b*–10*d* before "breakout". Door wing 10*a* is represented by the solid line in alignment with the dashed line representing door wing 10*d* in FIGURE 6B. When door wings 10*a*–10*d* are broken out from the plus position, door wing 10*a* remains in its operating position and is not pivoted about either its primary pivot axis 120 or its secondary pivot axis 122. Door wings 10*b* and 10*c* are pivoted around their respective primary axes 120 toward door wing 10*a* until door wings 10*b* and 10*c* are substantially in parallel juxtaposition with door wing 10*a*, as shown in FIG. 6A. Door wing 10*d* is pivoted around its primary axis 120 until its pivot arms come into contact with elongated bar 38 of either door wing 10*b* or 10*c*, depending upon which direction door wing 10*d* is pivoted. In FIG. 6A, door wing 10*d* is pivoted clockwise, as viewed from the perspective of FIG. 6A, so that its pivot arms will contact elongated bar 38 of door wing 10*c* to arrest the pivoting motion. Door wing 10*d* is then pivoted about its secondary pivot axis 122 so as to be substantially in parallel relationship with door wings 10*a*–10*c*** to effect the book-fold arrangement.

Figure 7A:
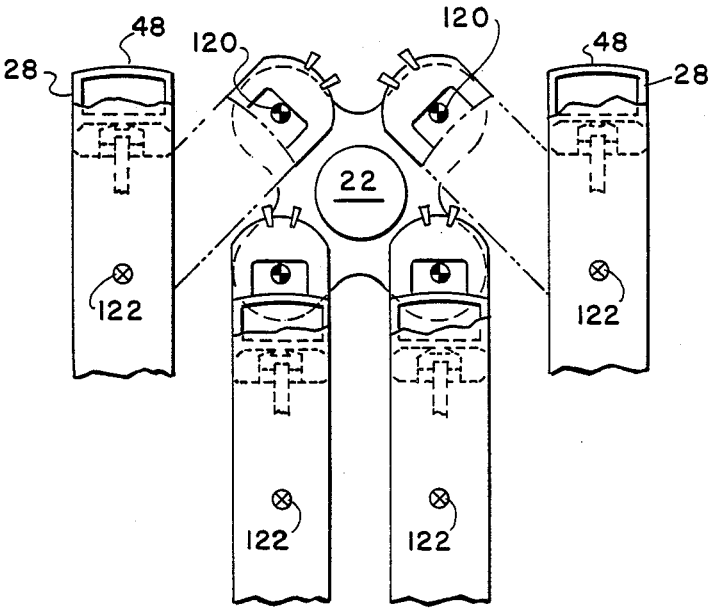
FIGURES 7A and 7B are respective top plan views depicting the breakout of four revolving door wings from respective second operative positions to a book-fold position according to the present invention.
Figure 7B:
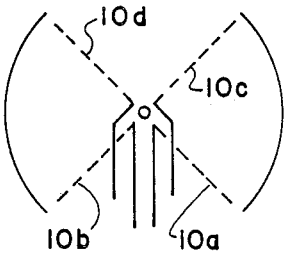

Referring to FIGS. 7A and 7B, door wings **10*a*–10*b* are broken out from their respective operating positions, which is depicted as a "cross" configuration in FIG. 7B. The dashed lines in FIG. 7B represent the respective operating positions of door wings 10*a*–10*d* and the solid lines represent the respective positions thereof after breakout and folding to a book-fold position. Door wings 10*a* and 10*b* are rotated about their respective primary pivot axes 120 toward one another until they are in substantially parallel relationship, as shown in FIG. 7A. Door wings 10*c* and 10*d* are pivoted away from one another and toward door wings 10*a* and 10*b* until their respective pivot arms come into contact with the respective elongated bars 38 of door wings 10*a* and 10*b*. At this point, door wings 10*c* and 10*d* are rotated about their respective secondary pivot axes 122 until door wings 10c and 10d are substantially parallel to door wings 10a and 10b**, as depicted in FIG. 7A.

One skilled in the art will appreciate that by providing two separate pivot connections for each door wing, the individual door wings can be substantially completely book folded after breakout. Complete book folding is achieved by spacing secondary pivot axis 122 apart from primary pivot axis 120 a distance which is greater than or equal to the distance from primary pivot axis 120 to central shaft 22 plus the thickness of the corresponding door wing, as measured along an axis perpendicular to a major surface of the corresponding door wing. The respective normal operating positions of primary pivot axis 120 and second pivot axis 122 relative to central shaft 22 are best illustrated by door wing 10a in FIG. 6A.

Various embodiments of the invention have now been described in detail. Since it is obvious that many changes in and additions to the above-described preferred embodiment can be made without departing from the nature, spirit and scope of the invention, the invention is not to be limited to said details, except as set forth in the appended claims.

What is claimed is:

1. A revolving door assembly, comprising, in combination:

rotary support means having a central axis about which the assembly revolves and a plurality of arm members projecting substantially radially therefrom;

a plurality of door wings rotatably mounted on respective arm members at respective proximate positions relative to the central axis, such that the door wings are rotatable about respective pivot axes substantially parallel to said central axis; and means for releasably securing the door wings to the respective arm members at respective distal locations relative to the central axis, such that the door wings are normally retained in respective operative positions wherein the door wings extend substantially radially from the central axis in diametrically opposed pairs, said securing means for releasing a door wing in response to the exertion of a predetermined force thereon to enable said door wing to be rotated about its pivot axis to a folded position.

2. The assembly of claim 1 wherein said support means includes a plurality of fork projections, each of which has a pair of spaced-apart prongs for receiving a first portion of a corresponding arm member between the prongs, each arm member being coupled to a corresponding fork projection to secure the arm member to the support means.

3. The assembly of claim 1 wherein said pivot axes are located a predetermined distance from the central axis.

4. The assembly of claim 3 wherein said pivot axes include first pivot axes positioned a first predetermined distance from the central axis and second pivot axes positioned a second predetermined distance from the central axis, said second predetermined distance being greater than said first predetermined distance, each of said door wings being rotatable about its corresponding first axis or its corresponding second axis.

5. The assembly of claim 4 wherein the distance between the second pivot axis and the first pivot axis is at least as great as the distance between the first pivot axis and the central axis plus the thickness of the corresponding door wing along an axis perpendicular to a major surface of the corresponding door wing.

6. The assembly of claim 1 further including hinge means for rotatably mounting said door wings on said support means, said hinge means including a first hinge member for being connected to each of said door wings to rotatably mount each of said door wings on said support means and a second hinge member pivotally connected to the first hinge member spaced apart from the position at which the first hinge member is connected to the corresponding door wing to provide a second pivot axis for said door wing, said door wing being rotatable about its first pivot axis when the door wing is released from its corresponding arm member, such that the first and second hinge members will pivot along with said door wing about said first pivot axis, said door wing being rotatable about its second pivot axis when the first hinge member is constrained from further rotation, such that the door wing and the second hinge member will pivot about the second pivot axis.

7. The assembly of claim 6 wherein said first hinge member is comprised of a plurality of relatively flat first hinge plates in vertical stacked arrangement and said second hinge member is comprised of a plurality of relatively flat second hinge plates in vertical stacked arrangement.

8. The assembly of claim 7 further including a first spacer member disposed between each pair of first hinge plates and a second spacer member disposed between each pair of second hinge plates in the vertical stack.

9. The assembly of claim 8 further including a washer member disposed between the first hinge plate and an adjacent second hinge plate along the corresponding second pivot axis.

10. The assembly of claim 1 further including alignment means for maintaining each door wing substantially in vertical alignment when the corresponding door wing is rotated about its pivot axis.

11. The assembly of claim 10 wherein said alignment means includes an elongated bar for being positioned substantially in abutting relationship with an inner portion of each door wing between said inner portion of the door wing and the central axis.

12. The assembly of claim 11 further including a plurality of pivot members for pivotally mounting each door wing on the support means, said pivot members being attached to respective top and bottom portions of the elongated bar, such that the bar constrains the respective top and bottom pivot members to rotate substantially together when the corresponding door wing is rotated about its pivot axis.

13. The assembly of claim 1 wherein said securing means includes latch means distally positioned with respect to said central axis for securing each door wing to the corresponding arm member to maintain the door wing in its operative position, said latch means including a first latch member disposed on the corresponding door wing and a second latch member disposed on the corresponding arm member, said first latch member for normally engaging said second latch member to retain the corresponding door wing in its operative position, said first latch member being releasable from said second latch member in response to the exertion of a predetermined force on the door wing so that the door wing is rotatable away from the corresponding arm member.

14. The assembly of claim 13 wherein said first latch member includes a spring-biased ball catch and said second latch member includes an opening for receiving said ball catch to secure said first and second latch members together, said first and second latch members being disengageable by a force exerted on the corresponding door wing which overcomes the spring bias and moves the ball catch out of the opening.

15. A revolving door assembly having rotary central support means, a plurality of door wings mounted on the support means for revolving motion about a central axis extending through said support means, means for pivotally mounting the door wings relative to the support means so that the door wings are rotatable about respective pivot axes substantially parallel to and radially removed from the central axis and means for releasably securing the door wings to the support means, such that the door wings are normally retained in respective operative positions wherein the door wings extend substantially radially from the vertical axis, said securing means for releasing a door wing in response to the exertion of a predetermined force so that the door wing is rotatable about its pivot axis to a folded position, wherein the improvement comprises alignment means for maintaining each door wing substantially in vertical alignment when the door wing is rotated about its pivot axis.

16. The assembly of claim 15 wherein said alignment means includes an elongated bar for being positioned substantially in abutting relationship with each door wing, such that when the door wing is in an operative position, the bar is disposed between the central axis and an inner portion of the corresponding door wing, said bar for substantially preventing top and bottom portions of the corresponding door wing from differential rotation when said door wing is rotated about its pivot axis.

17. The assembly of claim 16 further including a plurality of pivot members mounted on respective top and bottom portions of the bar, said pivot members being connected to the corresponding door wing to couple the corresponding door wing to the bar, said bar for constraining said pivot members mounted at the top and bottom of the bar to rotate substantially together, thereby maintaining the corresponding door wing substantially in vertical alignment during rotation about its pivot axis.

18. The assembly of claim 16 wherein each of said door wings has first and second pivot axes, said first pivot axis extending along the major axis of said elongated bar and said second pivot axis being radially outward from said first pivot axis, such that said first pivot axis is between the central axis and the second pivot axis.

19. The assembly of claim 18 wherein the radial distance between the first and second pivot axes is at least as great as the radial distance between the first pivot axis and the central axis plus the thickness of the corresponding door wing along an axis perpendicular to a major surface of the door wing.

20. A revolving door assembly having rotary central support means, a plurality of door wings mounted on the support means for revolving motion about a central axis, means for pivotally mounting the door wings relative to the support means, such that the door wings are rotatable about respective pivot axes substantially parallel to said central axis and means for releasably securing the door wings to the support means, such that the door wings are retained in respective operative positions wherein the door wings extend substantially radially from the central axis in diametrically opposed pairs, the securing means for releasing the door wing in response to the exertion of a predetermined force to allow the door wing to be rotated about its pivot axis to a folded position, wherein the improvement comprises means for pivotally mounting each door wing relative to the support means, such that each door wing is rotatable about respective first and second pivot axes substantially parallel to the central axis, said second pivot axis being positioned outside of said first pivot axis, such that said first pivot axis is between the central axis and the second pivot axis, the distance between the first and second pivot axes being at least as great as the distance between the first pivot axis and the central axis plus the thickness of the door wing along an axis substantially perpendicular to a major surface of the door wing.

21. A revolving door assembly, comprising, in combination:

rotary central support means having a plurality of arm members projecting substantially radially therefrom;

a plurality of door wings mounted on respective arm members for revolving motion about a central axis;

means for pivotally mounting each door wing relative to its corresponding arm member, such that each door wing is rotatable about first and second pivot axes substantially parallel to the central axis, said second pivot axis being positioned outside of said first pivot axis such that said first pivot axis is between the central axis and the second pivot axis; and means for releasably securing the door wings to the respective arm members at respective distal positions relative to the central axis, such that the door wings are retained in respective operative positions wherein the wings extend substantially radially from the central axis in diametrically opposed pairs, said securing means for releasing a door wing in response to the exertion of a predetermined force thereon to allow said door wing to be rotated about one or both of its pivot axes to a folded position.

22. The assembly of claim 21 wherein the distance between the first and second pivot axes of each door wing is at least as great as the distance between the first pivot axis and the central axis plus the thickness of the corresponding door wing, as measured along an axis substantially perpendicular to a major surface of the corresponding door wing.

23. The assembly of claim 21 wherein said means for pivotally mounting said door wings includes hinge means positioned at the top and bottom of each door wing for pivotally mounting the corresponding door wing relative to the support means, said hinge means including a first hinge member for being pivoted about the first pivot axis adjacent to one end of said first hinge member and a second hinge member pivotally connected to an opposite end of said first hinge member, such that said second hinge member is rotatable about the second pivot axis, said first hinge member being constrained from rotation about said second pivot axis.

24. A revolving door assembly comprising, in combination:

rotary central support means having a central axis about which the assembly revolves;

a plurality of door wings;

means for releasably coupling the door wings to the support means, such that the door wings are normally retained in respective operative positions wherein the door wings extend substantially radially from the central axis; and means for pivotally mounting each door wing relative to the support means, such that each door wing is rotatable about first and second pivot axes substantially parallel to the central axis and radially removed therefrom, said second pivot axis being radially removed from said first pivot axis, such that said first pivot axis is between the central axis and the second pivot axis, said means for releasably coupling said door wings to the support means for releasing a door wing in response to the exertion of a predetermined force thereon, such that said door wing is rotatable about one or both of its pivot axes to a folded position.

25. The assembly of claim 24 wherein said means for releasably coupling said door wings to said support means includes a plurality of arm members projecting substantially radially from said support means and means for connecting each of said arm members to a corresponding one of said door wings at a corresponding distal position relative to said central axis.

26. The assembly of claim 25 wherein said means for pivotally mounting each door wing includes means for pivotally mounting each door wing relative to its corresponding arm member, such that each door wing is rotatable with respect to its corresponding arm member relative to said first and second pivot axes.

27. A revolving door assembly, comprising, in combination:

rotary support means having a central axis about which the assembly revolves and a plurality of arm members projecting substantially radially therefrom;

a plurality of door wings rotatably mounted on the respective arm members, such that the door wings are rotatable about respective pivot axes substantially parallel to said central axis; and means for releasably securing the door wings to the respective arm members, at respective distal locations relative to the central axis, such that the door wings are normally retained in respective operative positions wherein the door wings extend substantially radially from the central axis, said securing means for releasing a door wing in response to the exertion of a predetermined force thereon to enable said door wing to be rotated about its pivot axis to a folded position.

* * * * *

UNITED STATES PATENT AND TRADEMARK OFFICE

CERTIFICATE OF CORRECTION

PATENT NO. : 4,980,992

DATED : January 1, 1991

INVENTOR(S) : William S. Liles, et al.

It is certified that error appears in the above-identified patent and that said Letters Patent is hereby corrected as shown below:

In column 14, after line 24, please add the following claims:

28. A revolving door assembly having rotary central support means, a plurality of door wings mounted on the support means for revolving motion about a central axis, means for pivotally mounting the door wings relative to the support means, such that the door wings are rotatable about respective pivot axes substantially parallel to said central axis and means for releasably securing the door wings to the support means, such that the door wings are retained in respective operative positions wherein the door wings extend substantially radially from the central axis, the securing means for releasing the door wing in response to the exertion of a predetermined force to allow the door wing to be rotated about its pivot axis to a folded position, wherein the improvement comprises means for pivotally mounting each door wing relative to the support means, such that each door wing is rotatable about respective first and second pivot axes substantially parallel to the central axis, said second pivot axis being positioned outside of said first pivot axis, such that said first pivot axis is between the central axis and the second pivot axis, the distance between the first and second pivot axes being at least as great as the distance between the first pivot axis and the central axis plus the thickness of the door wing along an axis substantially perpendicular to a major surface of the door wing.

UNITED STATES PATENT AND TRADEMARK OFFICE

CERTIFICATE OF CORRECTION

PATENT NO. : 4,980,992

DATED : January 1, 1991

INVENTOR(S) : William S. Liles, et al

It is certified that error appears in the above-identified patent and that said Letters Patent is hereby corrected as shown below:

29. A revolving door assembly, comprising, in combination:

rotary central support means having a plurality of arm members projecting substantially radially therefrom;

a plurality of door wings mounted on respective arm members for revolving motion about a central axis;

means for pivotally mounting each door wing relative to its corresponding arm member, such that each door wing is rotatable about first and second pivot axes substantially parallel to the central axis, said second pivot axis being positioned outside of said first pivot axis such that said first pivot axis is between the central axis and the second pivot axis; and means for releasably securing the door wings to the respective arm members at respective distal positions relative to the central axis, such that the door wings are retained in respective operative positions wherein the wings extend substantially radially from the central axis, said securing means for releasing a door wing in response to the exertion of a predetermined force thereon to allow said door wing to be rotated about one or both of its pivot axes to a folded position.

Signed and Sealed this

Thirtieth Day of June, 1992

*Attest:*

DOUGLAS B. COMER

*Attesting Officer*

*Acting Commissioner of Patents and Trademarks*